US005743534A

United States Patent [19]

Pan

[11] Patent Number: 5,743,534

[45] Date of Patent: Apr. 28, 1998

[54] DARTS TARGET WITH TARGET INDICATION AND ELECTRICAL SCORING

[76] Inventor: John C. Pan, No. 81, Tehsheng Rd., Taya Hsaing, Taichung Hsien, Taiwan

[21] Appl. No.: 738,548

[22] Filed: Oct. 28, 1996

[51] Int. Cl.[6] ..... F41J 3/02

[52] U.S. Cl. ..... 273/371; 273/378

[58] Field of Search ..... 463/2, 7; 364/410; 273/317, 348, 371, 372, 378

[56] References Cited

U.S. PATENT DOCUMENTS

| | | | |
|---|---|---|---|
| 4,955,967 | 9/1990 | Houriet, Jr. et al. | 273/372 |
| 5,358,253 | 10/1994 | Chen | 273/371 |
| 5,366,230 | 11/1994 | Sanquinetti-Trigo | 273/371 |
| 5,531,451 | 7/1996 | Yiu | 273/371 |
| 5,540,445 | 7/1996 | Lee | 273/371 |
| 5,556,103 | 9/1996 | Arino | 273/371 |
| 5,559,490 | 9/1996 | McDonald et al. | 273/317 |
| 5,560,617 | 10/1996 | Liang | 273/371 |

*Primary Examiner*—Jessica Harrison
*Assistant Examiner*—James Schaaf
*Attorney, Agent, or Firm*—Foley & Lardner

[57] ABSTRACT

A kind of darts target with target indication and electrical scoring is disclosed. The darts target comprises a target defining a plurality of target areas, a plurality of pilot lamps arranged at positions the target for highlighting the corresponding target areas and electrically connected to a display output port of a microcomputer via a driver disposed within the target, and a control panel disposed below the target. The control panel includes an indicator for displaying score, and a set of function keys connected to the microcomputer for selecting various game modes. With this arrangement, game modes such as a random given mode, a hunting mode, a race mode and an interception mode can be obtained.

15 Claims, 2 Drawing Sheets

DARTS TARGET WITH TARGET INDICATION AND ELECTRICAL SCORING

BACKGROUND OF THE INVENTION

1. Field of the Invention

The present invention relates to a darts target with target indication and electrical scoring, and more particularly to a darts target which has a plurality of pilot lamps for highlighting a corresponding target area thereon to provide various game modes.

2. Description of Related Art

Conventional darts is generally are played in a manner of setting scores according to the hit positions on the target. The used target generally has a certain pattern on the surface thereof and can only provide a single and simple game mode. With the needs of improving enjoyment of the games, this kind of darts game has become boring and unsatisfactory. Therefore, it is necessary to develop a kind of more complex game to meet the needs of people.

The present invention provides an improved darts target with target indication and electrical scoring to mitigate and/or obviate the aforementioned problems.

SUMMARY OF THE INVENTION

One object of the present invention is to provide a darts target which has a plurality of pilot lamps for highlighting a corresponding target area thereon to provide various game modes and various levels of game difficulty.

In accordance with one aspect of the present invention, a darts target with target indication and electrical scoring includes a target defining a plurality of target areas. A plurality of pilot lamps are arranged at positions on the target for highlighting the corresponding target areas. The plurality of pilot lamps construct a matrix circuit connected with a display output port of a microcomputer disposed within the target. A control panel is disposed below the target. The control panel includes an indicator for displaying score and a set of function keys for selecting various game modes.

In accordance with another aspect of the present invention, the function keys can be selected to a random given mode, in which the microcomputer randomly controls any target area to be highlighted as an effective target in order to score only when the effective target is hit.

In accordance with a further aspect of the present invention, the function keys can be selected to a hunting mode, in which the microcomputer controls at least three target areas for a respective player to hit to be highlighted by the pilot lamps at the beginning of game. When the player is successful in hitting each target area, the respective pilot lamp will go out and the score according to the hit numbers of target areas will be recorded.

In accordance with still a further aspect of the present invention , the function keys can be selected to a race mode, in which the microcomputer controls the target areas to be equally divided into several parts according to the number of participants for said participants sequentially hitting the corresponding parts, if the area in one part is hit, the pilot lamp proceeds to highlight the next area in a clockwise direction, while if the area in the one part is not hit, that particular pilot lamp remains lit.

In accordance with still a further aspect of the present invention, the function keys can be selected to an interception mode, in which the microcomputer controls the target areas to be rotationally highlighted in order to record a score when one highlighted area is hit.

Other objects, advantages and novel features of the invention will become more apparent from the following detailed description when taken in conjunction with the accompanying drawings.

DETAILED DESCRIPTION OF PREFERRED EMBODIMENT

Figure 1:
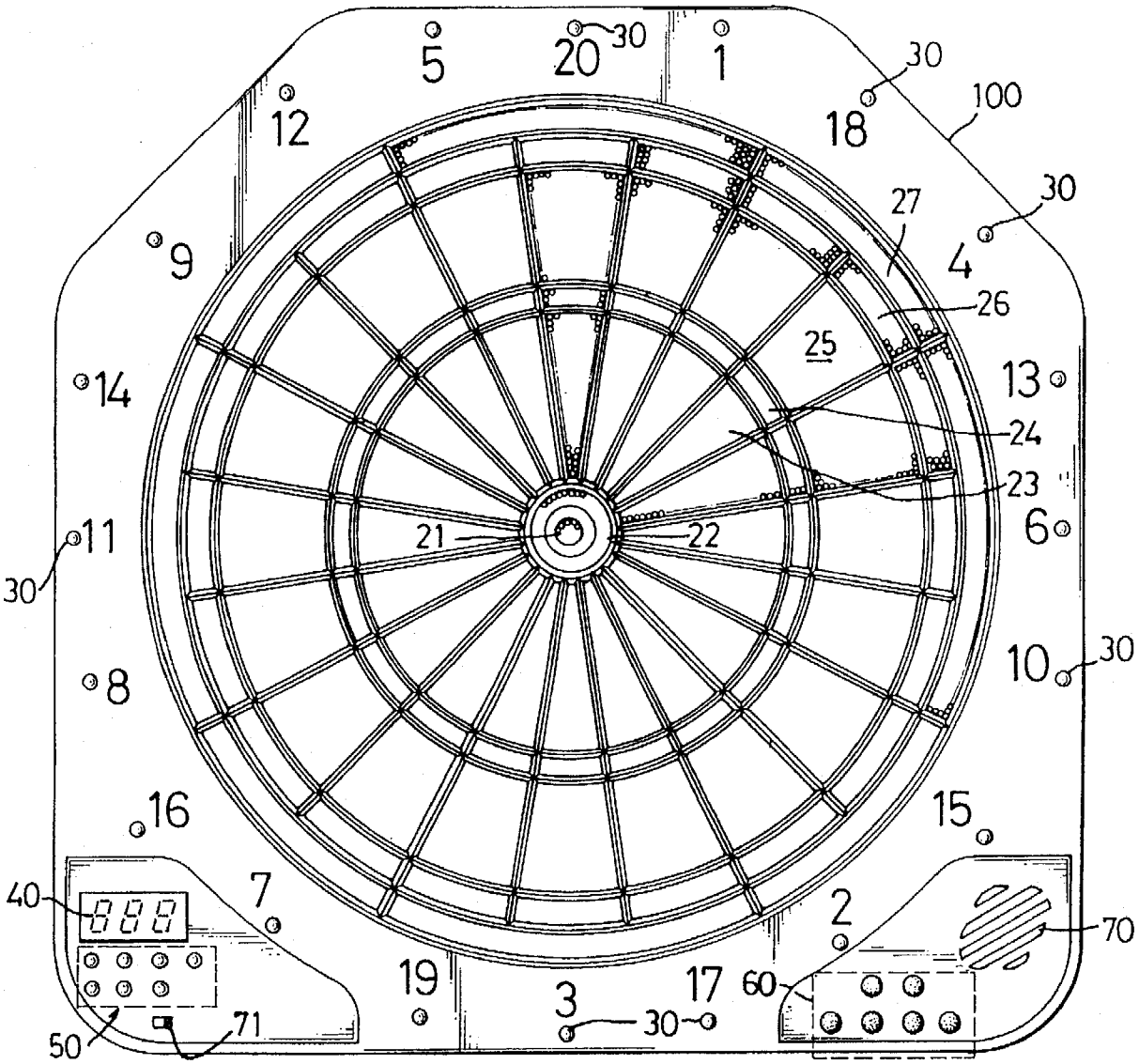
FIG. 1 is a front view showing a darts target with target areas indication and electrical scoring in accordance with the present invention.

Referring to FIG. 1, a darts target with target area indication and electrical scoring in accordance with the present invention includes a target 100. The target 100 defines a plurality of target areas 21~27 which is similar to the conventional darts target. A control panel (not numbered) is disposed below the target 100. The control panel includes a seven segment or digit indicator 40 for displaying score, a plurality of function indicators 50 for displaying the operation modes, a set of function keys 60 for selecting various game modes, a loudspeaker 70, and a switch 71 for turning on and turning off the loudspeaker 70. A plurality of light emitting diodes (LED) 30 are respectively arranged at an outside of the outermost target area 27 on the target 100 to form an indicator set 300 (see FIG. 2) for highlighting the corresponding target areas 21~27. The light emitting diodes 30 are connected with a microcomputer 13 (not shown) within the target 100 and controlled by a firmware of the microcomputer after the function keys 60 are selected.

Figure 2:
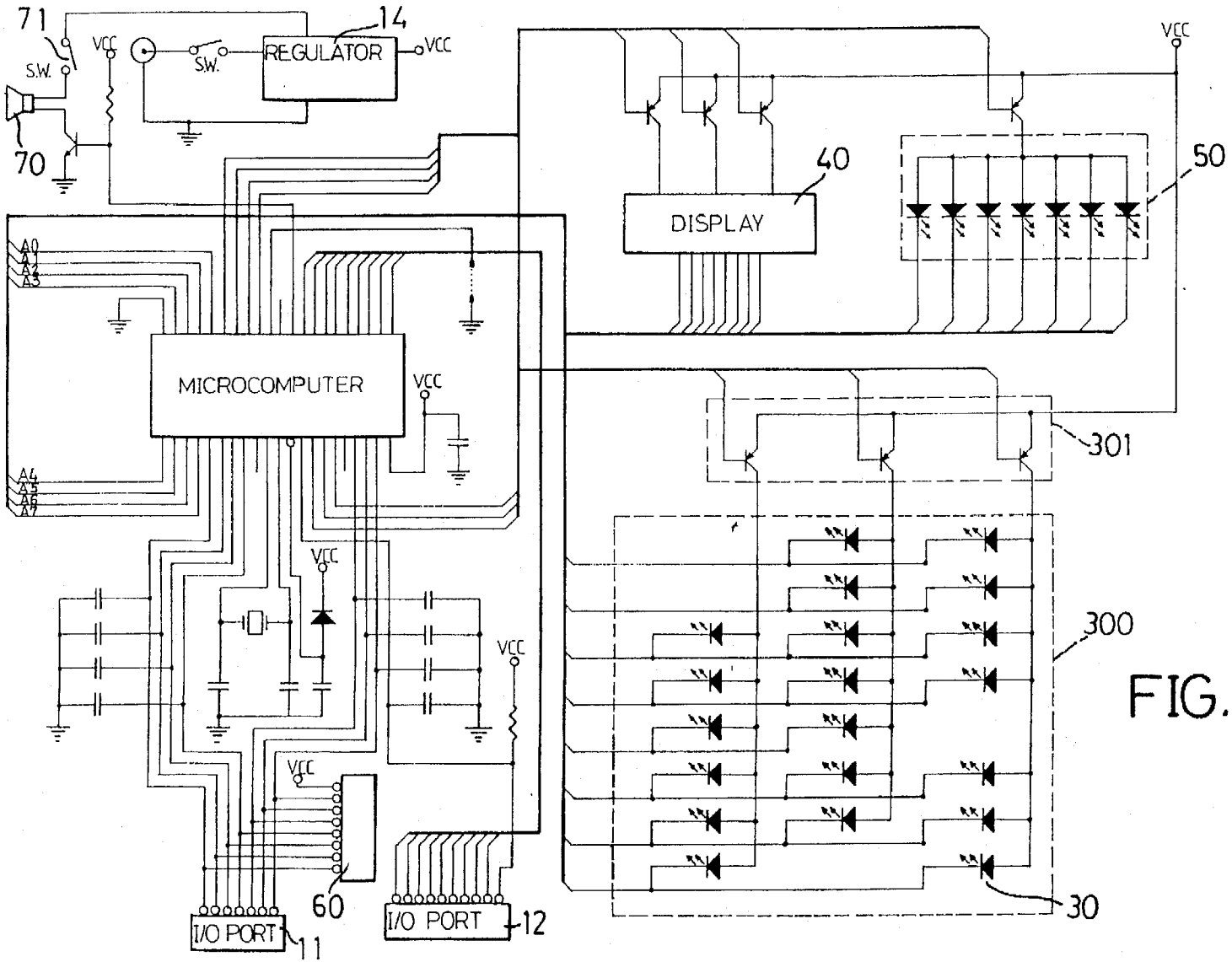
FIG. 2 is a circuit diagram showing a control circuit within the darts target in accordance with the present invention.

FIG. 2 shows a circuit diagram of a control circuit within the darts target in accordance with the present invention. The control circuit includes a voltage regulator 14 for supplying direct current. The scan output and input ends of the microcomputer 13 are respectively connected to output and input ports 11, 12 of a tablet and the function keys 60 so that the microcomputer 13 can receive the signals of locations of target hit to determine the score record and scoring according to the signals. The microcomputer 13 further has an output connected to the loudspeaker 70 and the switch 71 so that sound can be sent out when the microcomputer 13 receives a signal of target being hit. The microcomputer 13 further has a display output port connected to the seven-stage indicator 40 and the plurality of function indicators 50 so that the indicator 40, 50 can display the present score and mode.

Still in FIG. 2, the indicator set 300 formed by the plurality of LEDs 30 is connected to the display output port of the microcomputer 13 via a driver 301 in order to be controlled by the microcomputer 13.

As above mentioned, the plurality of LEDs 30 are controlled by the microcomputer 13 to highlight the corresponding target area 21~27 after the function keys 60 are selected for providing various game modes. Firstly, the function keys 60 can be selected to a random given mode, wherein the microcomputer 13 randomly controls any target area from 21 to 27 to be highlighted as an effective target. The remaining areas are considered as ineffective areas so that scoring is carried on only when the effective target is hit.

Secondly, the function keys 60 can be selected to a hunting mode, wherein the microcomputer 13 controls at least three among the target areas from 21 to 27 to be highlighted at the beginning of a game and shut off one by one when hit, thereby to scoring according to the numbers of target areas being hit.

Also, the function keys 60 can be selected to a race mode, wherein the microcomputer 13 controls the target areas from 21 to 27 to be equally divided into several parts according to the number of participants, then the participants sequentially hit their corresponding parts, if the target area in one part is hit, the LED proceeds to highlight the next area in a clockwise direction, while if the target area is not hit, the LED will remain on in situ. When one player is caught up with by the following player, the previous player will be disqualified.

Further, the function keys 60 can be selected to an interception mode, wherein the microcomputer 13 controls the target areas from 21 to 27 to be rotationally highlighted, thereby to record a score only when any highlighted area is hit.

To increase the game's level of difficulty, the target areas 21~27 can also be selectively set as an effective area so that scoring occurs only when the effective area is hit.

It is to be understood , however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A darts target with target indication and electrical scoring comprising:

a target defining a plurality of target areas;

a plurality of pilot lamps arranged at positions on the target for highlighting the corresponding target areas, the plurality of pilot lamps constructing a matrix circuit connected with a display output port of a microcomputer disposed within the target; and a control panel disposed below the target, the control panel including an indicator for displaying a score and a set of function keys for selecting various game modes, the function keys being capable of selecting a random given mode, in which the microcomputer randomly controls any target area to be highlighted as an effective target in order to record a score only when the effective target is hit.

2. A darts target with target indication and electrical scoring as claimed in claim 1 wherein the plurality of pilot lamps are light emitting diodes.

3. A darts target with target indication and electrical scoring as claimed in claim 1, wherein the plurality of pilot lamps are connected to the display output port of the microcomputer via a driver.

4. A darts target with target indication and electrical scoring comprising:

a target defining a plurality of target areas;

a plurality of pilot lamps arranged at positions on the target for highlighting the corresponding target areas, the plurality of pilot lamps constructing a matrix circuit connected with a display output port of a microcomputer disposed within the target; and a control panel disposed below the target, the control panel including an indicator for displaying a score and a set of function keys for selecting various game modes, the function keys being capable of selecting a hunting mode, in which the microcomputer controls at least three target areas to be highlighted by the pilot lamps at the beginning of a game and shuts off each highlighted area one by one when hit in order to record a score according to the hit numbers of target areas.

5. A darts target with target indication and electrical scoring as claimed in claim 4, wherein the plurality of pilot lamps are light emitting diodes.

6. A darts target with target indication and electrical scoring as claimed in claim 4, wherein the plurality of pilot lamps are connected to the display output port of the microcomputer via a driver.

7. A darts target with target indication and electrical scoring comprising:

a target defining a plurality of target areas;

a plurality of pilot lamps arranged at positions on the target for highlighting the corresponding target areas, the plurality of pilot lamps constructing a matrix circuit connected with a display output port of a microcomputer disposed within the target; and a control panel disposed below the target, the control panel including an indicator for displaying a score and a set of function keys for selecting various game modes, the function keys being capable of selecting a race mode, in which the microcomputer controls the target areas to be equally divided into several parts according to the number of participants for the participants sequentially hitting the corresponding parts, if the area in one part is hit, the pilot lamp proceeds to highlight the next area in a clockwise direction, while if the area in the one part is not hit, the pilot lamp remains lit.

8. A darts target with target indication and electrical scoring as claimed in claim 7, wherein the plurality of pilot lamps are light emitting diodes.

9. A darts target with target indication and electrical scoring as claimed in claim 7, wherein the plurality of pilot lamps are connected to the display output port of the microcomputer via a driver.

10. A darts target with target indication and electrical scoring comprising:

a target defining a plurality of target areas;

a plurality of pilot lamps arranged at positions on the target for highlighting the corresponding target areas, the plurality of pilot lamps constructing a matrix circuit connected with a display output port of a microcomputer disposed within the target; and a control panel disposed below the target, the control panel including an indicator for displaying a score and a set of function keys for selecting various game modes, the function keys being capable of selecting an interception mode, in which the microcomputer controls the target areas to be rotationally highlighted in order to record a score when one highlighted area is hit.

11. A darts target with target indication and electrical scoring as claimed in claim 10, wherein the plurality of pilot lamps are light emitting diodes.

12. A darts target with target indication and electrical scoring as claimed in claim 10, wherein the plurality of pilot lamps are connected to the display output port of the microcomputer via a driver.

13. A darts target with target indication and electrical scoring comprising:

a target defining a plurality of target areas;

a plurality of pilot lamps arranged at positions on the target for highlighting the corresponding target areas, the plurality of pilot lamps constructing a matrix circuit connected with a display output port of a microcomputer disposed within the target; and a control panel disposed below the target, the control panel including an indicator for displaying a score and a set of function keys for selecting various game modes, the target areas being capable of being selectively set as an effective area for increasing the game's level of difficulty by allowing scoring to occur only when the effective area is hit.

14. A darts target with target indication and electrical scoring as claimed in claim 13, wherein the plurality of pilot lamps are light emitting diodes.

15. A darts target with target indication and electrical scoring as claimed in claim 13, wherein the plurality of pilot lamps are connected to the display output port of the microcomputer via a driver.

* * * * *